United States Patent [19]

Shenoha

[11] 4,121,520

[45] Oct. 24, 1978

[54] LARGE AREA IMPRINTING DEVICE

[75] Inventor: James L. Shenoha, Lockport, Ill.

[73] Assignee: Norwood Marking & Equipment Co., Downers Grove, Ill.

[21] Appl. No.: 774,439

[22] Filed: Mar. 4, 1977

[51] Int. Cl.[2] ..... B41F 1/06

[52] U.S. Cl. ..... 101/316; 101/41

[58] Field of Search ..... 101/9, 27, 41, 35, 287, 101/288, 316, 292, 336, 3 SP

[56] References Cited

U.S. PATENT DOCUMENTS

| | | | |
|---|---|---|---|
| 761,991 | 7/1904 | Phelps | 101/316 |
| 1,463,322 | 7/1923 | Jackson | 101/3 SP |
| 1,599,917 | 9/1926 | O'Hara | 101/41 |
| 2,776,509 | 1/1957 | Kienel | 101/316 X |
| 3,693,543 | 9/1972 | Nolher | 101/316 X |
| 3,878,776 | 4/1975 | Schneider | 101/41 |
| 4,029,010 | 6/1977 | Deisting | 101/316 |

*Primary Examiner*—Edward M. Coven

*Attorney, Agent, or Firm*—Hill, Gross, Simpson, Van Santen, Steadman, Chiara & Simpson

[57] ABSTRACT

A large area intermittent imprinter having transfer tape supply and take-up reels carried by a main frame with guide means directing the tape past a large area imprint head carried on a shaft reciprocatingly journaled in the main frame support and coupled to a reciprocating drive means through a cam and follower connection to a pivoted force transmitting member whereby the large area imprint head is stabilized through the journal support with the drive connection consisting of a simple rigid linkage.

5 Claims, 6 Drawing Figures

LARGE AREA IMPRINTING DEVICE

BACKGROUND OF THE INVENTION

1. Field of the Invention

This invention relates to imprinting devices and more particularly to a large area intermittent imprinter.

2. Prior Art

Intermittent imprinters are well known to the art and include devices which constitute a main frame providing support for transfer tape supply and take-up reels and guide means for guiding the tape from the supply reel to the take-up reel across an area immediately adjacent a marking head. The marking head may include a heater block and a replaceable printing block which has raised printing indicia thereon. A power member, normally an air cylinder or the like, including a powered moving portion, activates the intermittent imprinter and either moves an anvil towards and away from the fixed printing block, as shown in my U.S. Pat. No. 3,823,446, the teachings of which are herein incorporated by reference, or the actuator may move the marker head and printing block towards and away from a fixed anvil. Normally the same power member is used to drive the tape drive system.

Marking in these prior art devices is accomplished by interposing an item to be marked between the printing block and tape and the anvil and thereafter moving either the anvil or the printing block into pressed engagement with the tape and the tape into pressed engagement with the item to be marked. The tape used in connection with a popular type of marker is a heat transfer tape having one face thereof coated with pigmentation which, when subjected to the heated printing block and pressure, transfers a portion corresponding to the raised indicia onto the item to be marked.

Of course other marking devices are well known including those using inked tapes, and mechanisms using ink rollers to ink the printing block.

Almost exclusively, the above described type of imprinter has a fixed limitation on the size of the imprint area. Although there is relatively little limitation on the size of the tape that can be used, the size of the printing block and the marker head is limited due to the necessity of quickly overcoming the inertia of a large mass. These marking devices operate at comparatively high speeds and heretofore, marking devices have not had sufficient marking head stability to allow the use of large size marking heads. In addition the type of power actuator linkage connections which have been used have not been conducive to movement of large mass printing heads. Thus, previously existing transfer tape intermittent imprinters have been restricted to an overall imprint area of approximately 2 inches by 2 inches. However there exists a demand for transfer tape imprinters capable of clearly and rapidly intermittently imprinting an area of larger size.

SUMMARY OF THE INVENTION

My invention overcomes the disadvantages of prior intermittent transfer tape imprinters.

In the illustrated construction, I have made an intermittent transfer tape imprinter wherein the printing block is carried in a marker head member having a large head portion. On the opposite side of the head portion from the raised indicia of the printing block, an integral shaft portion is provided of relatively large diameter. The shaft portion is journaled in a bore through a portion of a main frame. The bore is relatively axially long providing sufficient stability to the marker head to allow it to be axially reciprocated without unwanted wobble which could otherwise produce a smeared imprint.

In order to provide for movement of the marker head, I have devised a relatively short pivoting linkage to a power member such as an air or hydraulic cylinder. The pivoting linkage has a cam groove or slot in one end and a connection to the powered moving portion of the power member at the other end. An intermediate shaft pivot is provided and a cam follower wheel carried by the shaft of the marker head member rides in the groove or slot. By using a cam and follower connection, axial movement of the marker head will be precise while the configuration of the cam slot or groove can be modified to provide both positive movement and, if desired, a dwell period allowing extra movement of the linkage to occur without causing further movement of the marker head. Thus overtravel of the powered moving portion of the power member can be accommodated.

In addition, in my construction, transfer tape supply and take-up reels are mounted on the main frame as are guide bars which guide the tape past the marker head. A tape drive mechanism including a rotating drive roller and opposed spring pressure roller are also provided with the drive roller rotated by a clutched linkage connection to the force transmitting member or to its connected shaft.

Additionally, I have disclosed a novel clutch drive and brake for both the drive roller and supply and take-up reels.

The invention is illustrated in association with a fixed anvil and a film transport system whereby the intermittent imprint marker is used for marking of plastic film or the like which moves past the marker.

It is therefore an object of this invention to provide a transfer tape intermittent imprint marker capable of imprinting relatively large areas.

It is another object of this invention to provide an intermittent imprint transfer tape marker having a marking head with a projecting shaft portion journaled in a main frame bore and reciprocatively driven by a pivoting linkage to a reciprocating power member.

It is another and more particular object of this invention to provide an intermittent imprint marker for use with transfer tape having a main frame with a relatively large diameter bore therethrough having a bearing therein with a shaft of a relatively large dimensioned marker head received in the bearing for reciprocation therein, the marker head carrying a relatively large area printing block, the marker head driven by a cam and follower connection to an arcuately pivoting linkage member carried on a shaft attached to the main frame, the shaft rotating with the linkage member, the linkage member having a connection to a pivotable power member having a reciprocatingly moving powered moving portion, with a transfer tape drive actuated by rotation of the linkage force transmitting member shaft.

Other objects, features and advantages of the invention will be readily apparent from the following description of a preferred embodiment thereof, taken in conjunction with the accompanying drawings, although variations and modifications may be effected without departing from the spirit and scope of the novel concepts of the disclosure, and in which:

DESCRIPTION OF THE PREFERRED EMBODIMENT

Figure 1:
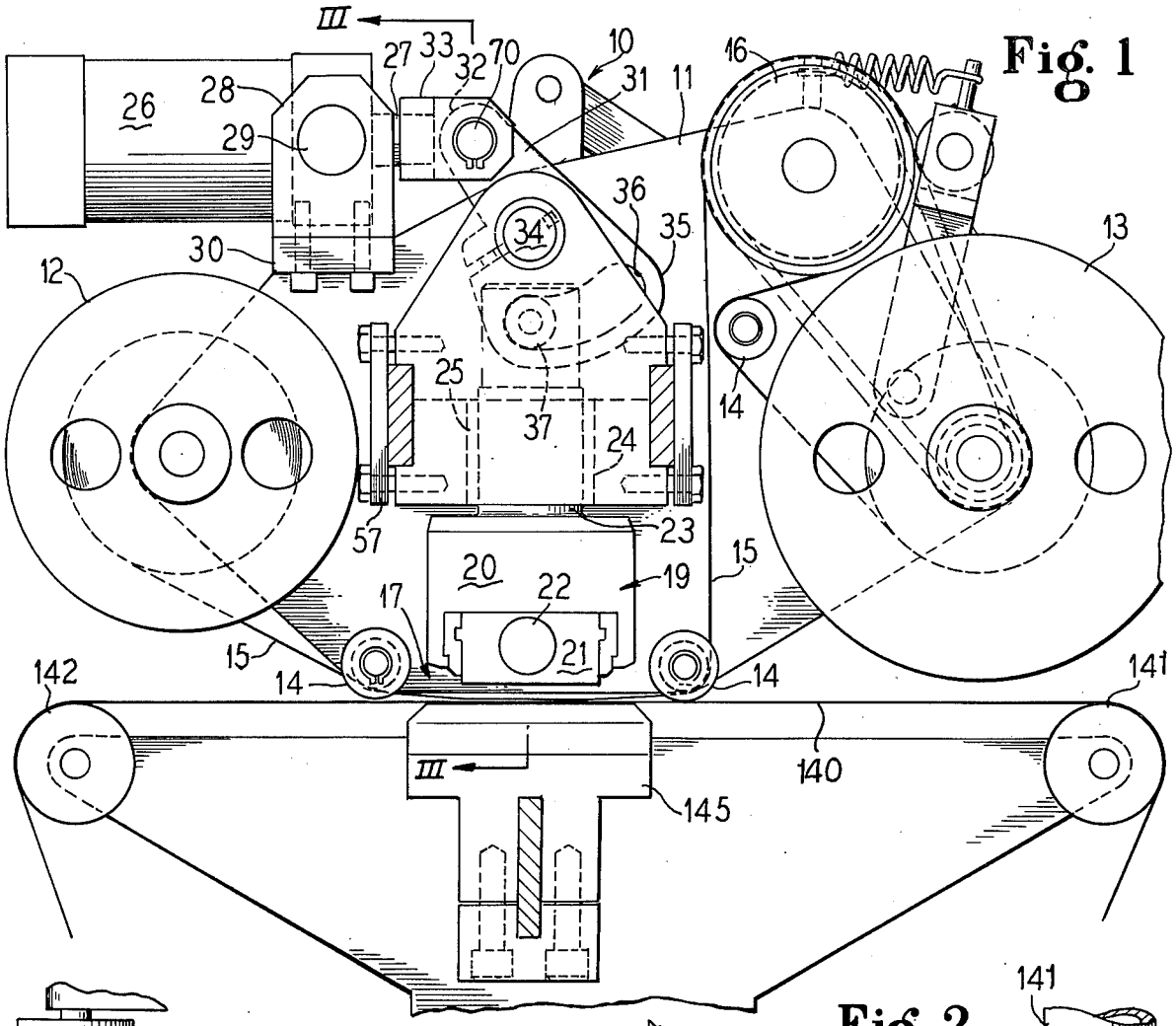
FIG. 1 is a fragmentary side view of a marker according to this invention.

FIG. 1 illustrates an intermittent imprint marker 10 according to this invention which includes a main frame 11 carrying tape supply 12 and take-up reels 13 and tape guides 14 which guide movement of transfer tape 15 from the supply reel past a marking station 17 and a drive roller 16 to the take-up reel 13.

At the marking station 17 a marker head member 19 has a head portion 20 carrying a removable printing block 21. The printing block may have a handle 22 thereon for ease of removal and insertion into the internally grooved head portion. On the side of the head portion opposite the printing block, a marker head member shaft portion 23 projects through a bore 24 in a central horizontal portion of the main frame 11. Received in the bore between the shaft and the bore wall is a bearing 25 which may be of the sleeve or journal bearing type and which is of sufficient length to stabilize the marker head portion 20 when the marker head member reciprocates in the bore. A power member 26 such as an air cylinder or the like having a powered moving portion or arm 27 is pivotally attached to a bracket 28 as at 29, the bracket being mounted on the main frame as at 30. A force transmitting member 31 comprises a link having a first end 32 attached to a bracket 33 carried by the end of the powered moving portion 27. A central portion of the force transmitting member is attached to a shaft 34 which provides a pivot or fulcrum for the force transmitting member. The second end 35 of the force transmitting member includes a cam slot 36 in which a cam wheel 37 rides. The cam wheel is attached to the shaft portion of the marker head member.

Figure 3:
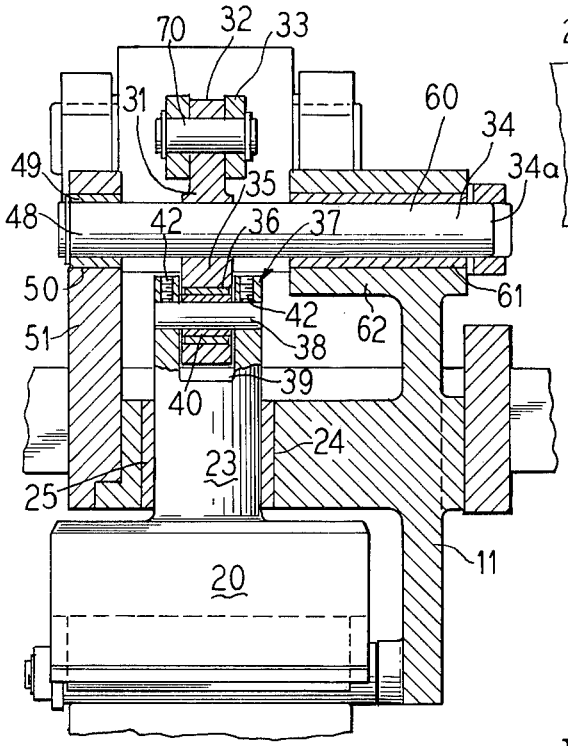
FIG. 3 is a fragmentary cross-sectional view taken along the lines III—III of FIG. 1.
Figure 4:
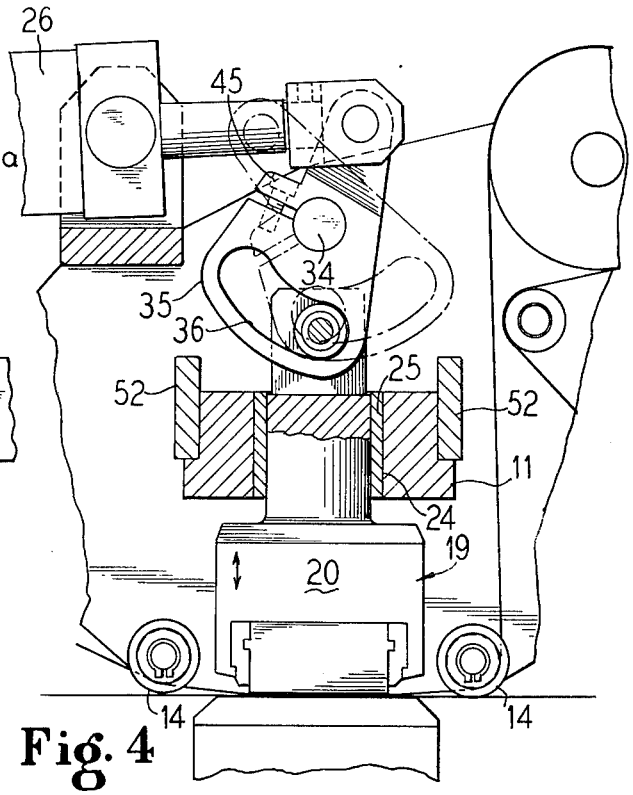
FIG. 4 is a fragmentary view of the central portion of FIG. 1 illustrating movement of the marker head taken along the IV—IV of FIG. 2.
Figure 6:
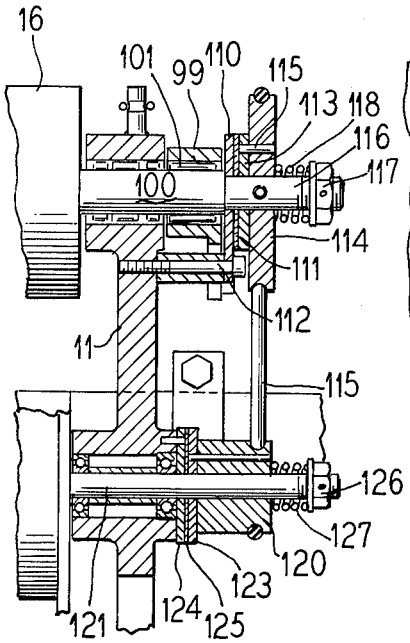
FIG. 6 is a fragmentary cross-sectional view taken along the lines VI—VI of FIG. 5.

As best illustrated in FIGS. 3 and 4, in the embodiment illustrated, the cam wheel 37 consists of a shaft 38 which spans an end slot 39 in the shaft portion and which is received in bearings 40 which in turn are received in the slot 36. The shaft 38 is held against rotation by lock screws 42. Thus, as the powered moving portion 27 of the power member 26 acts upon the first end 32 of the force transmitting member 31, it will rotate with the shaft 34 causing arcuate movement of the slot 36 in second end 35 with respect to the cam wheel 37. This will cause the cam wheel 37 and its attached head member shaft portion 23 to move axially in the bearing 25 with rotational movement accommodated by the bearings 40.

In order to maintain the desired stability of the marker head member 19, it is desired that the force transmitting member have minimal play. Thus, as is clearly shown in FIG. 3, the force transmitting member 31 is a relatively sturdily constructed, subtantial, solid link which is fixedly carried on shaft 34 which constitutes an axle. A clamp bolt 45 is utilized, in the preferred embodiment illustrated, to fixedly secure the force transmitting member 31 to the axle shaft 34.

Figure 2:
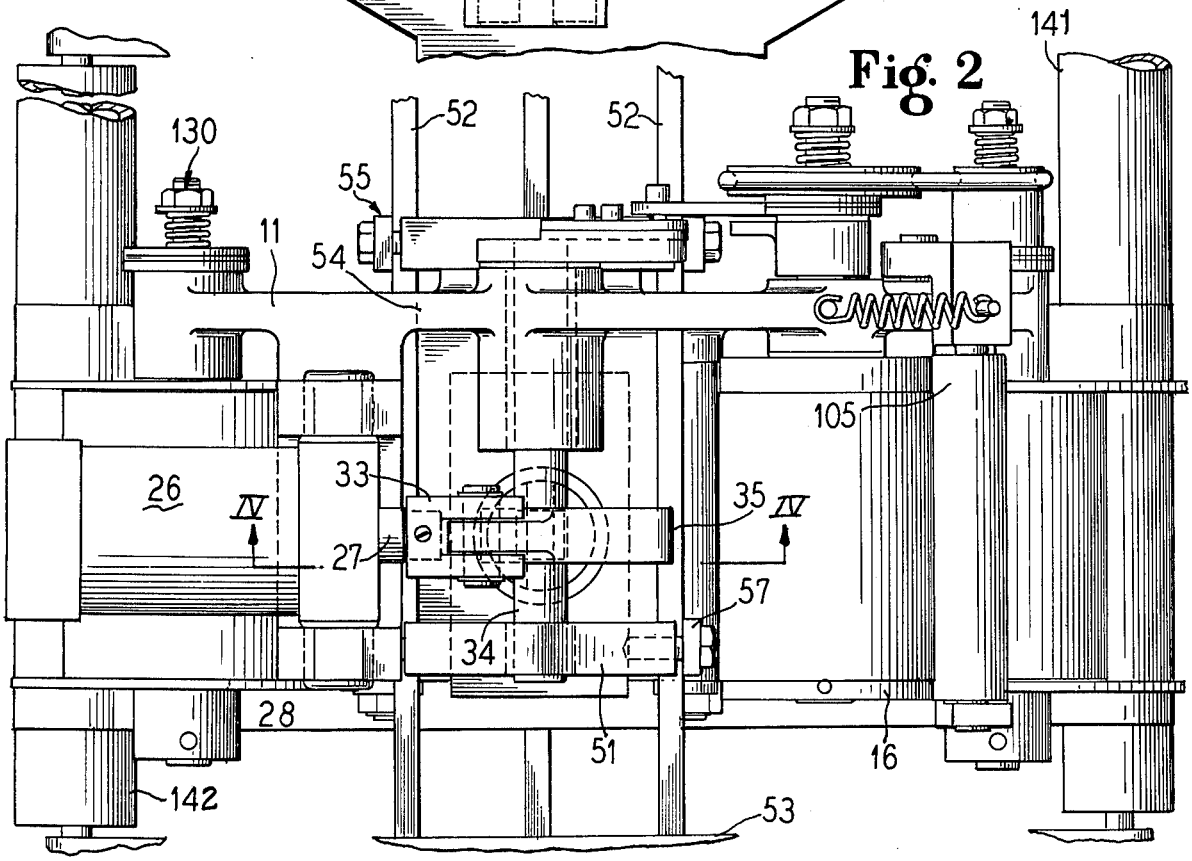
FIG. 2 is a fragmentary top view of the marker of FIG. 1.

The axle shaft 34 has one end 48 thereof journaled in a bearing 49 received in a bore 50 of a bearing block 51 which is securely positioned at the front, or bottom as illustrated in FIG. 2 of the central horizontal portion of the main frame 11.

Figure 5:
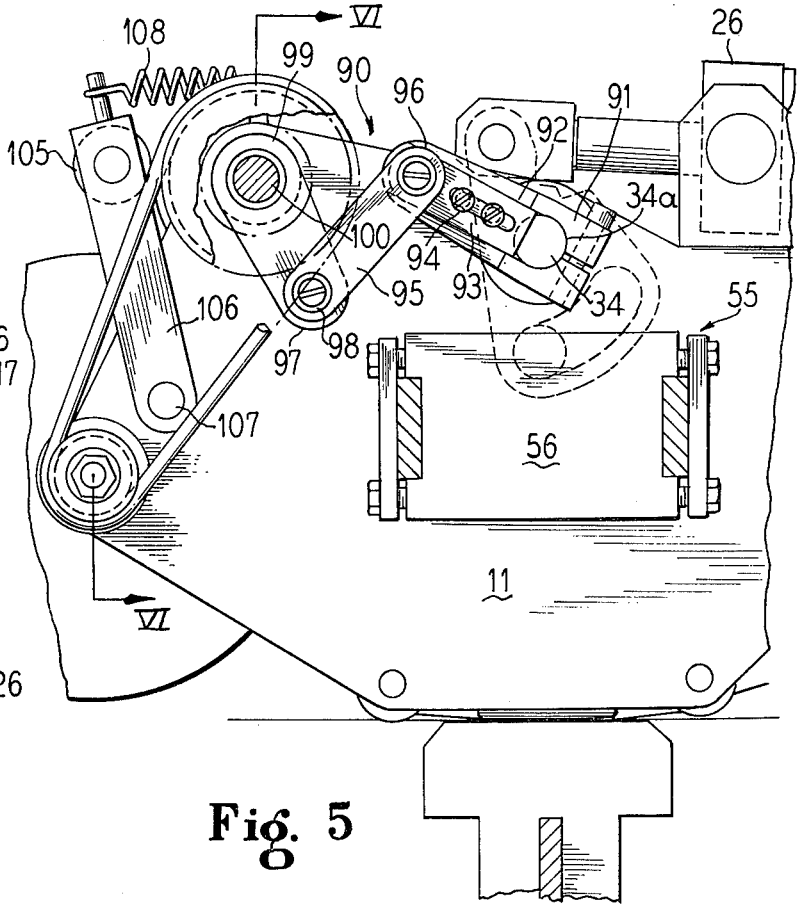
FIG. 5 is an enlarged fragmentary view of the side of the marker opposite the side of FIG. 1 showing the tape drive.

As best illustrated in FIGS. 1 and 2, the main frame is mounted on parallel flat bars 52 which may have their ends attached to a supporting structure 53. The bars 52 extend through the main vertically disposed section 54 of the main frame 11 with the frame 11 clamped thereto as at 55, as best shown in FIG. 5. The frame has a boss portion 56 thereat. Additional clamps 57 secure the block 51 in position at the front of the central horizontal portion of the main frame. The clamps 55 and 57 can be loosened to allow lateral displacement of the main frame along the bars 52 to allow movement of the intermittent marker with respect to its supporting machinery or base.

The end portion 60 of the axle shaft 34 opposite the end 48 is supported in a bushing 61 received in a boss 62 of the main frame 11, the boss 62 and bushing 61 being relatively elongated to provide substantial stability to the axle shaft 34. A portion 34A of the axle shaft extends beyond the end of the boss 62 and bushing 61 to provide a tape drive connection as hereinafter described.

Therefore, as will be appreciated from the above, operation of the marker head member 19 is controlled by actuation of the power member 26 to move the powered moving portion 27 which in turn moves the bracket 33 which is connected to the force transmitting member 31 at an end 32 thereof through a pivot connection including shaft 70. The pivot connection of the power member at 29 allows the power member to tilt to accommodate the arcuate movement of the shaft 70 as the force transmitting member 31 rotates with axle shaft 34. The slot 36 on the second end 35 of the force transmitting member then moves with respect to the cam wheel assembly 37 imparting an axial movement to the cam wheel assembly 37 which is formed as an end portion of the head member shaft portion 23. This will result in a purely axial motion of the shaft portion 23 thereby carrying the head portion 20 and attached printing block 21 in a reciprocating axial movement. The cam slot 36 can be dimensioned so as to provide dwell periods at both axial ends of movement of the head portion 20 thereby allowing positive movement while allowing overage movement of the power member.

A major reason for the success of this device is that the cam drive allows use of wide tape. The cam interposed between the power member 26 and the head member 19 allows controlled reduction of acceleration changing the print action from an impact system to a smooth low impact jolt free system where the head presses the tape into print contact rather than banging it into print contact. Additionally the cam allows provision of greater print force at the print position without jarring the system. Further the cam drive allows precise positioning of the print point on bottom dead movement location. Thus changing of the anvil 145 position allows specific print compression of different materials to be marked to be obtained.

Tape movement is controlled by a crank assembly 90 best illustrated in FIG. 5. The assembly includes a clamp bracket 91 which is attached to the end 34A of the axle shaft 34. The bracket has a groove 92 therein with a slidable member 93 received in the groove and held therein by fastening devices such as bolts 94. A link member 95 has one end pivotally attached to the slidable member 93 as at 96 and another end pivotably attached to crank 97 as at 98. The crank 97 has one end attached to the link at 98 and has its other end 99 received around a shaft 100 of the drive roller 16 with a one way rachet clutch 101 interposed between the crank 99 and the shaft 100.

Thus, as the axle shaft 34 rotates back and forth under the movement of the power member 26, the bracket 91 will pivot. This movement will be transferred to the crank 97 through the link 95. By sliding the member 93 inwardly and outwardly with respect to the center line of the axle shaft 34, the degree of movement of the crank 97 and therefore of rotation of the shaft 100 can be controlled. In this manner tape advance per imprint can be controlled.

A pressure roller 105 mounted adjacent one end of a pivotable support link 106 which is pivotably attached to the main frame 11 as at 107 is urged into abutment with the drive roller 16 by a spring 108. With the tape 15 passing around the drive roller 16 and between the drive roller and pressure roller, as illustrated in FIG. 1, movement of the tape past the marking head will be completely controlled in response to actuation of the power member 26.

When a large printing head 21 is utilized, adjustment of the crank link by movement of the sliding member 93 on the bracket 91 can provide for a large tape movement with each actuation of the power member 26. Conversely, when it is desired to imprint only a small area with a small print head, the crank assembly can be adjusted to move a relatively smaller amount of tape with each actuation of the power member. By providing a one-way clutch 101, it is assured that the tape will be moved only in one direction thereby preventing the same tape portion from being struck successively by the print head. When transfer tape is used, pigmentation is transferred from the tape to the article to be marked, it is desired to move that portion of the tape beyond the printing head before the printing head again makes contact with the tape.

In order to prevent any back rotation of the drive roller 16 during back movement of the crank 97, a brake system is provided. The brake system includes plate number 110 which is attached to the main frame 11 by means of pin 112 thereby preventing rotation of plate 110, and interposed friction disk 111 and plate 113. Plate 113 is attached to sheave wheel 114 by means of pin 115. An extension 116 of shaft 100 terminates in a threaded portion which receives a nut and washer 117 with a spring 118 entrapped between the washer and the sheave wheel 114. Thus tightening of the nut to compress the spring allows the friction pad 111 to act as a drag brake to prevent back rotation of the shaft 100. Sheave wheel 114 and nut 117 are attached to the shaft by set screws.

The sheave wheel 114 has a drive band 115 received in a peripheral groove, the drive band extending around a sheave wheel 120 of smaller diameter. The sheave wheel 120 is received around a shaft 121 journaled through a boss in the main frame 11 with the shaft 121 supporting the tape take-up reel 13. Sheave 120 is pinned for rotation to plate 123 while plate 124 is pinned to stationary frame 11 with a friction pad 125 interposed between plates 123 and 124. The shaft 121 has a nut and washer 126 threaded on an end thereof with a spring 127 interposed between the sheave 120 and the washer in substantially the same manner as described above in connection with shaft 100. As sheave 120 is caused to rotate by rotation of sheave 114, the rotation will be transmitted through the spring 127 to the nut 126 which is locked to shaft 121 by a set screw thereby causing rotation of shaft 121. Tightening of the nut will compress the spring increasing resistence to rotation because of the friction pad 125. This may provide a slippage of the drive belt 115 with respect to the shaft 121. This allows the shaft 121 to rotate in dependent relationship to rotation of shaft 100 but at differing speeds without the necessity of having interposed transmissions or the like. Since the take-up reel starts out empty, and then fills as the tape is moved past the marking head, the rotation necessary for the take-up reel 13 to take up all tape passing the drive wheel changes as more tape is taken up. The above-described construction allows this to occur even though the amount of rotation imparted by the crank 97 remains the same with each actuation of the power cylinder 26.

Substantially the same type of drag or friction clutch system is utilized in connection with the tape supply roller as indicated at 130 of FIG. 2 thereby preventing both back rotation of the tape supply reel and providing a resistence to withdrawal of the tape from the supply reel which resistence insures that the tape will be tautly stretched across the guide members 14 past the marking head.

As a further modification which is particularly useful in large width tapes, I have reversed the tape drive. The effect of this is to push the tape past the print head. This prevents tape stretch which would occur when the tape is pressed against the anvil 145 while further movement of the drive is attempting to move the tape. This can be accomplished by making reel 13 the supply reel and reel 12 the take-up reel. The tape is then reversed around the drive roll 16. In order to assure tape take-up on the reel 12, a drive belt can be connected over an idler from the drive roll 16 to the take-up reel 12. A brake assembly such as 130 is used on the supply reel 13 and the drive belt 115 thus runs to reel 12 rather than reel 13.

As illustrated in FIG. 1, this construction is usable in connection with strip marking systems which will pass a strip to be marked 140 between guides 141 and 142 past the marker station 17 and above a stationary anvil 145. The strip to be marked 140 may be moved past the marker station 17 in unison with the actuation of the power member 26 so that a successive series of spaced imprints will be provided on the strip 140. That strip may, for example, consist of a series of attached together bags, or other material to be imprinted, such as self-adhesive labels on a roll of underlying film or any of numerous desired articles to be marked.

It can therefore be seen from the above that my invention provides a large area intermittent imprint marker particularly adapted for use with transfer tape. The marker features a large area imprint head which is reciprocated between a printing position and a withdrawn position, the reciprocation caused by a power member with force from the moving portion of the power member being transmitted to the marker head through a rigid force transmitting member and a cam and follower connection to a large diameter shaft end of the marker head. The shaft end is securely journaled in a bore in a stationary frame member.

Although the teachings of my invention have herein been discussed with reference to specific theories and embodiments, it is to be understood that these are by way of illustration only and that others may wish to utilize my invention in different designs or applications.

I claim as my invention:

1. An imprinting device comprising: a main frame having spaced apart film tape supply and take-up supports and a marker head support portion, guide means on said main frame guiding tape from a tape supply reel carried on the supply support past the marker head support portion below a marker head carried thereby to a tape take-up reel carried on the take-up support, a marker head member having a head portion carrying a printing block with raised printing indicia thereon projecting beyond one side of the head portion, a shaft portion projecting from an opposite side of the head portion, the shaft portion reciprocatingly journalled in a bore in the marker head support portion of the main frame, a power member carried by the main frame having a powered moving portion, a force transmitting member having a first end portion connected to the powered moving portion, an intermediate portion carried by the main frame and a second end portion, a cam and follower connection between the second end portion and the shaft portion transmitting movement of the powered moving portion to movement of the head portion, a tape drive carried by the main frame, a drive connection between the powered moving portion and the tape drive for moving tape from the supply to the take-up reel in dependent response to movement of the power member, the main frame having means rotatably supporting a second shaft with portions of the second shaft in axially spaced relationship to the shaft portion of the marker head member, the force transmitting member carried by said second shaft portions and movable therewith, bracket means attached to said main frame pivotably supporting the power member, the powered moving portion of the power member extending from the power member and being movable towards and away therefrom to pivot the force transmitting member with respect to the main frame on the second shaft, the said second end portion has a closed slot therethrough, the slot having a major dimension transverse of an axial line of the shaft portion of the marker head member, the marker head member having a cam wheel member received in said slot and engaging peripheral edges of said slot whereby pivotable movement of the force transmitting member on the second shaft causes said slot to move relative to said cam wheel.

2. The device of claim 1 wherein the slot is curved.

3. The device of claim 1 wherein the cam wheel comprises an open slot in an axial end of the shaft portion of the marker head member, a pin bridging said open slot, the pin extending through the closed slot in the force transmitting member, and means allowing relative rotation between the pin member and the peripheries of the force transmitting member slot.

4. An imprinting device comprising a main frame having a marker head support land portion, said land portion having a bore therethrough, an anti-friction member in said bore, a large size marker head member having an imprint area greater than 2 by 2 inches, the head member having a shaft portion projecting from a head portion, the shaft portion received through anti-friction means in the bore, said shaft portion and anti-friction means being in area contact providing firm stability against transverse direction movements of said shaft and marker head member with respect to said land, said shaft portion having an axial end spaced from said head portion, said axial end projecting from said anti-friction means on an opposite side of said land from said head portion, a force transmitting member having a central portion pivotably carried on said main frame by a pivotable connection thereto, said connection in spaced relation to said land and aligned with said bore, a power member pivotably carried by said main frame having a reciprocatably movable power arm positioned for movement of the arm in a plane transverse the axis of the shaft portion, said power member pivotably attached to one end of the force transmitting member, and a cam and follower connection between a second end of the force transmitting member opposite the one end and the shaft portion of the marker head member whereby reciprocal movement of the power arm pivots the force transmitting member causing relative movement between the cam and follower effective to reciprocate the shaft portion.

5. The device of claim 4 wherein the cam connection between the force transmitting member and the shaft portion includes a slot adjacent the second end of the force transmitting member and a follower carried by the shaft portion having portions thereof received in said slot in contact with at least portions of peripheral walls of the slot.

* * * * *